US009225131B2

(12) United States Patent
Ernest et al.

(10) Patent No.: US 9,225,131 B2
(45) Date of Patent: Dec. 29, 2015

(54) LOW VOLTAGE POWER SUPPLY WITH MAGNETIC CONNECTIONS

(71) Applicant: RTC Industries, Inc., Rolling Meadows, IL (US)

(72) Inventors: Joseph C. Ernest, Woodstock, IL (US); Thomas E. Hubley, Fox River Grove, IL (US); John W. Swafford, Jr., Palatine, IL (US)

(73) Assignee: RTC Industries, Incorporated, Rolling Meadows, IL (US)

( * ) Notice: Subject to any disclaimer, the term of this patent is extended or adjusted under 35 U.S.C. 154(b) by 50 days.

(21) Appl. No.: 13/918,281

(22) Filed: Jun. 14, 2013

(65) Prior Publication Data

US 2013/0337668 A1 Dec. 19, 2013

Related U.S. Application Data

(60) Provisional application No. 61/660,060, filed on Jun. 15, 2012.

(51) Int. Cl.
*H01R 25/00* (2006.01)
*H01R 25/14* (2006.01)

(52) U.S. Cl.
CPC ..... *H01R 25/147* (2013.01)

(58) Field of Classification Search
USPC ..... 439/110, 116, 118–119; 262/219–227, 262/398, 404
See application file for complete search history.

(56) References Cited

U.S. PATENT DOCUMENTS

| | | | | |
|---|---|---|---|---|
| 3,622,938 | A | 11/1971 | Ito et al. | |
| 4,414,617 | A * | 11/1983 | Galindo | 362/404 |
| 4,861,273 | A | 8/1989 | Wenman et al. | |
| 4,875,871 | A | 10/1989 | Booty, Sr. et al. | |
| 5,025,355 | A * | 6/1991 | Harwood | 362/147 |
| 5,154,509 | A * | 10/1992 | Wulfman et al. | 362/648 |

(Continued)

FOREIGN PATENT DOCUMENTS

| | | | |
|---|---|---|---|
| CA | 2178502 | A1 | 6/1995 |
| CA | 2173799 | A1 | 10/1997 |

(Continued)

OTHER PUBLICATIONS

International Search Report from International PCT Application No. PCT/US2014/043831 dated Aug. 13, 2014.

(Continued)

*Primary Examiner* — Jean F Duverne
(74) *Attorney, Agent, or Firm* — Banner & Witcoff, Ltd.

(57) ABSTRACT

A low voltage power assembly may comprise a track that includes one or more conductive plates and one or more metal plates, wherein the track is powered from a low voltage power source; and a power connector assembly that connects to the track, wherein the one or more conductive plates connect to the power assembly providing a low voltage power connection, and further wherein the one or more metal plates connect to the power assembly providing a magnetic connection. The power connector assembly may be configured to provide low voltage power through the track to a low voltage power device. The low voltage power assembly may include a configuration of ferrous material, conductive material, and non-conductive materials arranged in such a way as to provide a method for power and/or signal distribution to a mating device, such as to a set of magnetic LED modules.

20 Claims, 7 Drawing Sheets

(56) References Cited

U.S. PATENT DOCUMENTS

| | | | | | |
|---|---|---|---|---|---|
| 5,168,173 | A * | 12/1992 | Windsor | 307/139 |
| 5,205,638 | A | 4/1993 | Squitieri | |
| 5,319,250 | A * | 6/1994 | Windsor | 307/139 |
| 5,366,100 | A | 11/1994 | Maglione | |
| 5,545,958 | A | 8/1996 | Kramer | |
| 5,551,577 | A | 9/1996 | Hagopian | |
| 5,588,537 | A | 12/1996 | Hagopian | |
| 5,673,985 | A | 10/1997 | Mitchell | |
| 5,695,261 | A | 12/1997 | Slesinger et al. | |
| 5,746,332 | A | 5/1998 | Kleinschmidt | |
| 5,758,585 | A | 6/1998 | Latchinian | |
| 5,785,411 | A * | 7/1998 | Komai et al. | 362/219 |
| 5,794,794 | A | 8/1998 | Hull | |
| 5,810,457 | A | 9/1998 | Felsenthal et al. | |
| 5,811,892 | A | 9/1998 | Battles et al. | |
| 5,829,864 | A | 11/1998 | Scanlan | |
| 5,921,190 | A | 7/1999 | Wood | |
| 6,021,908 | A | 2/2000 | Mathews | |
| 6,033,097 | A * | 3/2000 | Harwood | 362/404 |
| 6,113,198 | A | 9/2000 | Hommes | |
| 6,135,583 | A | 10/2000 | Simon et al. | |
| 6,138,583 | A | 10/2000 | Mahone et al. | |
| 6,204,632 | B1 | 3/2001 | Nierescher et al. | |
| 6,231,205 | B1 | 5/2001 | Slesinger et al. | |
| 6,302,282 | B1 | 10/2001 | Gay et al. | |
| 6,364,273 | B1 | 4/2002 | Otema | |
| 6,406,108 | B1 | 6/2002 | Upton et al. | |
| 6,460,470 | B1 | 10/2002 | Scharer et al. | |
| 6,478,444 | B2 | 11/2002 | Schaerer et al. | |
| 6,527,406 | B1 | 3/2003 | Slesinger et al. | |
| 6,543,688 | B1 | 4/2003 | Massaro | |
| 6,550,673 | B2 | 4/2003 | Massaro | |
| 6,619,814 | B1 | 9/2003 | Hamada et al. | |
| 6,669,029 | B1 | 12/2003 | Beane | |
| 6,742,907 | B2 | 6/2004 | Funamoto et al. | |
| 6,749,116 | B2 | 6/2004 | Massaro | |
| 6,796,248 | B1 | 9/2004 | Dressendorfer et al. | |
| 6,895,705 | B2 | 5/2005 | Hillstrom et al. | |
| 6,902,308 | B2 | 6/2005 | Love | |
| 6,932,446 | B2 | 8/2005 | Hales | |
| 7,025,217 | B2 | 4/2006 | Crown et al. | |
| 7,040,494 | B2 | 5/2006 | Harper | |
| 7,121,675 | B2 | 10/2006 | Ter-Hovhannisian | |
| 7,137,727 | B2 | 11/2006 | Joseph et al. | |
| 7,172,332 | B2 | 2/2007 | Mobarak et al. | |
| 7,173,821 | B2 | 2/2007 | Coglitore | |
| 7,175,034 | B2 | 2/2007 | Nook et al. | |
| 7,201,487 | B2 | 4/2007 | Pinter | |
| 7,201,488 | B2 | 4/2007 | Sakamoto et al. | |
| 7,367,685 | B2 | 5/2008 | Moll | |
| 7,453,419 | B2 | 11/2008 | Yee et al. | |
| 7,537,374 | B2 | 5/2009 | Schardt et al. | |
| 7,597,462 | B2 | 10/2009 | Misof | |
| 7,614,350 | B2 | 11/2009 | Tuttle et al. | |
| 7,665,860 | B2 | 2/2010 | Demarest et al. | |
| 7,743,933 | B2 | 6/2010 | Martin et al. | |
| 7,784,885 | B2 | 8/2010 | Steiger et al. | |
| 7,806,268 | B2 | 10/2010 | Angelocci | |
| 7,806,543 | B2 | 10/2010 | Swofford et al. | |
| 7,832,874 | B2 | 11/2010 | Ikeda et al. | |
| 7,832,888 | B2 | 11/2010 | Demarest et al. | |
| 7,840,286 | B2 | 11/2010 | Caldwell et al. | |
| 7,857,214 | B2 | 12/2010 | Saliaris | |
| 7,909,499 | B2 | 3/2011 | Snagel et al. | |
| 7,954,958 | B2 | 6/2011 | Ikeda et al. | |
| 7,997,430 | B2 | 8/2011 | Clark et al. | |
| 8,021,009 | B2 | 9/2011 | Knoll et al. | |
| 8,047,657 | B2 | 11/2011 | Ikeda et al. | |
| 8,123,052 | B2 | 2/2012 | Clark et al. | |
| 8,128,272 | B2 | 3/2012 | Fine et al. | |
| 8,135,482 | B2 | 3/2012 | Caldwell et al. | |
| 8,651,711 | B2 * | 2/2014 | Rudisill et al. | 362/398 |
| 2002/0073902 | A1 | 6/2002 | Jipp | |
| 2003/0056697 | A1 | 3/2003 | Crown et al. | |
| 2003/0084827 | A1 | 5/2003 | Nicholson et al. | |
| 2003/0179578 | A1 * | 9/2003 | Albert et al. | 362/276 |
| 2003/0223232 | A1 * | 12/2003 | Belfer et al. | 362/219 |
| 2004/0222720 | A1 | 11/2004 | Ellis | |
| 2005/0173605 | A1 | 8/2005 | Villeneuve et al. | |
| 2007/0262685 | A1 | 11/2007 | Randolph | |
| 2007/0294926 | A1 | 12/2007 | Andersen et al. | |
| 2008/0121146 | A1 | 5/2008 | Burns et al. | |
| 2008/0155915 | A1 * | 7/2008 | Howe et al. | 52/220.3 |
| 2008/0230497 | A1 | 9/2008 | Strickland et al. | |
| 2008/0258595 | A1 | 10/2008 | Nielsen | |
| 2009/0122575 | A1 | 5/2009 | Omura et al. | |
| 2009/0273730 | A1 | 11/2009 | Mills | |
| 2009/0279298 | A1 | 11/2009 | Mier-Langner et al. | |
| 2009/0308286 | A1 | 12/2009 | Bourbeau | |
| 2010/0012600 | A1 | 1/2010 | Clontz et al. | |
| 2010/0135038 | A1 | 6/2010 | Handschy et al. | |
| 2010/0149835 | A1 | 6/2010 | Cho et al. | |
| 2010/0214802 | A1 | 8/2010 | Masuda et al. | |
| 2010/0302803 | A1 | 12/2010 | Bita et al. | |
| 2010/0321929 | A1 | 12/2010 | Ramirez et al. | |
| 2011/0054673 | A1 | 3/2011 | Segal et al. | |
| 2011/0068071 | A1 | 3/2011 | Suman et al. | |
| 2011/0128471 | A1 | 6/2011 | Suckling et al. | |
| 2011/0128481 | A1 | 6/2011 | Wang | |
| 2011/0132854 | A1 | 6/2011 | Berdahl et al. | |
| 2011/0136353 | A1 | 6/2011 | Spitaels et al. | |
| 2011/0168651 | A1 | 7/2011 | Stenftenagel et al. | |
| 2011/0199555 | A1 | 8/2011 | Coe-Sullivan et al. | |
| 2011/0204009 | A1 | 8/2011 | Karan | |
| 2011/0216387 | A1 | 9/2011 | Whitehead et al. | |
| 2011/0227487 | A1 | 9/2011 | Nichol et al. | |
| 2011/0273867 | A1 | 11/2011 | Horst et al. | |
| 2011/0292679 | A1 | 12/2011 | Kim | |
| 2011/0309041 | A1 | 12/2011 | Amadio et al. | |
| 2012/0001295 | A1 | 1/2012 | Kronholz et al. | |
| 2012/0063125 | A1 | 3/2012 | Quaal et al. | |
| 2012/0085713 | A1 | 4/2012 | Bowser et al. | |
| 2013/0044501 | A1 | 2/2013 | Rudisill et al. | |

FOREIGN PATENT DOCUMENTS

| | | | |
|---|---|---|---|
| CA | 2250945 | A1 | 10/1997 |
| CA | 2393427 | A1 | 6/2001 |
| CA | 2467585 | A1 | 5/2003 |
| CA | 2471190 | A1 | 12/2004 |
| CA | 2443755 | A1 | 4/2005 |
| CA | 2485670 | A1 | 4/2005 |
| CA | 2554834 | A1 | 8/2005 |
| CA | 2525992 | A1 | 5/2006 |
| CA | 2501809 | A1 | 9/2006 |
| CA | 2558608 | A1 | 2/2008 |
| CA | 2568612 | A1 | 4/2008 |
| CA | 2671794 | A1 | 6/2008 |
| CA | 2653264 | A1 | 8/2009 |
| CA | 2706720 | A1 | 9/2009 |
| CA | 2681996 | A1 | 4/2010 |
| CA | 2752749 | A1 | 11/2011 |
| DE | 202010003919 | U1 | 7/2010 |
| EP | 1286612 | A1 | 3/2003 |
| EP | 1830680 | A1 | 9/2007 |
| EP | 1839539 | A2 | 10/2007 |
| FR | 2850550 | A1 | 8/2004 |
| FR | 2852502 | A1 | 9/2004 |
| FR | 2859889 | A1 | 3/2005 |
| FR | 2860133 | A1 | 4/2005 |
| FR | 2869779 | A1 | 11/2005 |
| FR | 2881331 | A1 | 8/2006 |
| FR | 2891716 | A1 | 4/2007 |
| FR | 2923578 | A1 | 5/2009 |
| FR | 2940031 | A1 | 6/2010 |
| FR | 2946852 | A1 | 12/2010 |
| FR | 2950412 | A1 | 3/2011 |
| FR | 2955193 | A1 | 7/2011 |
| FR | 2960395 | A1 | 12/2011 |
| GB | 2297896 | A | 8/1996 |
| GB | 2325148 | A | 11/1998 |
| KR | 20070106298 | A | 11/2007 |
| WO | 9318499 | A1 | 9/1993 |
| WO | 9603902 | A1 | 2/1996 |

(56) References Cited

FOREIGN PATENT DOCUMENTS

| | | | |
|---|---|---|---|
| WO | 9705809 | A1 | 2/1997 |
| WO | 9738610 | A1 | 10/1997 |
| WO | 9851963 | A2 | 11/1998 |
| WO | 0024297 | A1 | 5/2000 |
| WO | 0075561 | A1 | 12/2000 |
| WO | 0100065 | A1 | 1/2001 |
| WO | 0143598 | A1 | 6/2001 |
| WO | 0145537 | A1 | 6/2001 |
| WO | 0193728 | A1 | 12/2001 |
| WO | 03063655 | A1 | 8/2003 |
| WO | 03070060 | A1 | 8/2003 |
| WO | 2004102354 | A2 | 11/2004 |
| WO | 2005074635 | A2 | 8/2005 |
| WO | 2006067396 | A1 | 6/2006 |
| WO | 2006086998 | A1 | 8/2006 |
| WO | 2007016515 | A1 | 2/2007 |
| WO | 2008073829 | A2 | 6/2008 |
| WO | 2008133712 | A1 | 11/2008 |
| WO | 2010005093 | A1 | 1/2010 |
| WO | 2011046593 | A2 | 4/2011 |
| WO | 2011115685 | A1 | 9/2011 |

OTHER PUBLICATIONS

Dec. 8, 2014—(US) Non-Final Office Action—U.S. Appl. No. 13/924,948.

Apr. 9, 2015—(US) Non Final Office Action—U.S. Appl. No. 14/254873.

* cited by examiner

LOW VOLTAGE POWER SUPPLY WITH MAGNETIC CONNECTIONS

CROSS REFERENCE TO RELATED APPLICATIONS

This Application claims priority to U.S. Provisional Application Ser. No. 61/660,060, filed Jun. 15, 2012. The above-identified U.S. applications are herein incorporated by reference in their entirety.

FIELD OF INVENTION

This invention relates generally to low voltage power systems. In particular, in one aspect of the invention, a low voltage power supply with magnetic connections is provided.

BACKGROUND

In many exemplary power/signal systems, there is a problem with providing power to many devices while trying to create good wire management. Additionally, there is a problem with providing power to many devices while creating a dynamic or flexible system that allows for device relocation, addition of devices, and removal of devices for the power/signal systems. Existing solutions provide cable raceways with multiple connection points (outlet strip approach) or power track systems (track lighting approach). Although many conductors for power and signal combinations can be used, the "outlet strip approach" lacks flexibility and expandability for adding or relocating devices. Traditional powered track systems lack easy ways to incorporate many power and signal conductors. Additionally for each conductor added to the traditional power track systems the connector required to access those conductors grows significantly in complexity and size.

In one exemplary aspect of the present invention, a low voltage power system may include a configuration of ferrous material, conductive material, and nonconductive materials arranged in such a way as to provide a method for power and/or signal distribution to a mating device, such as to a set of magnetic LED modules or other similar low voltage power devices. Generally, low voltage power systems and low voltage power devices have a voltage of approximately 24 volts or less.

SUMMARY

The following presents a general summary of aspects of the invention in order to provide a basic understanding of the invention and various features of it. This summary is not intended to limit the scope of the invention in any way, but it simply provides a general overview and context for the more detailed description that follows.

In one exemplary embodiment, a low voltage power assembly may comprise: (a) a track that includes a first end and a second end opposite the first end, wherein the track is powered from a low voltage power source; and (b) a power connector assembly that connects to the track both through a magnetic connection and a low voltage power connection. The power connector assembly may be configured to provide low voltage power through the track to a low voltage power device. The track may include one or more conductive plates that connect to the power connector assembly providing the low voltage power connection. Additionally, the track may include one or more metal plates that connect to the power connector assembly providing the magnetic connection. The low voltage power device may be, for example, an LED lighting system for a merchandise display system.

In another exemplary embodiment, a low voltage power assembly may comprise: (a) a track that includes one or more ferrous plates and one or more conductive plates adjacent to one another, wherein the track is powered from a low voltage power source; and (b) a printed circuit board that connects to the track both through a magnetic connection and a low voltage power connection. The printed circuit board may be configured to provide low voltage power through the track to a low voltage power device. The printed circuit board may include one or more contacts that connect to the one or more conductive plates on the track providing the low voltage power connection. Additionally, the printed circuit board may include one or more magnets that connect to the one or more ferrous plates on the track providing the magnetic connection. The low voltage power device may be, for example, an LED lighting system for a merchandise display system.

In another exemplary embodiment, a low voltage power assembly may comprise a track that includes one or more conductive plates and one or more metal plates, wherein the track is powered from a low voltage power source; and a power connector assembly that connects to the track, wherein the one or more conductive plates connect to the power assembly providing a low voltage power connection, and further wherein the one or more metal plates connect to the power assembly providing a magnetic connection. The power connector assembly may be configured to provide low voltage power through the track to a low voltage power device. The low voltage power assembly may include a configuration of ferrous material, conductive material, and nonconductive materials arranged in such a way as to provide a method for power and/or signal distribution to a mating device, such as to a set of magnetic LED modules.

Other objects and features of the invention will become apparent by reference to the following description and drawings.

BRIEF DESCRIPTION OF THE DRAWINGS

A more complete understanding of the present invention and certain advantages thereof may be acquired by referring to the following detailed description in consideration with the accompanying drawings, in which.

The reader is advised that the attached drawings are not necessarily drawn to scale.

DETAILED DESCRIPTION

In the following description of various example structures in accordance with the invention, reference is made to the accompanying drawings, which form a part hereof, and in which are shown by way of illustration of various structures in accordance with the invention. Additionally, it is to be understood that other specific arrangements of parts and structures may be utilized, and structural and functional modifications may be made without departing from the scope of the present invention. Also, while the terms "top" and "bottom" and the like may be used in this specification to describe various example features and elements of the invention, these terms are used herein as a matter of convenience, e.g., based on the example orientations shown in the Figures and/or the orientations in typical use. Nothing in this specification should be construed as requiring a specific three dimensional or spatial orientation of structures in order to fall within the scope of this invention.

These embodiments illustrate a low voltage power supply with magnetic connections. These systems allow for an easy method of distributing both power and other signals without the need for complex wiring and secondary wire management. Additionally, the attachment of devices to the track system is magnetic. Uses for the invention include but are not limited to retail environments that may require periodic/regular relocation of devices connected to the distribution track. These embodiments are intended to distribute both power while allowing the easy movement and placement of connected devices such as lighting systems for the retail merchandise display systems.

An embodiment of an exemplary low voltage power system is illustrated in FIGS. 1 through 7. Generally, the low voltage power system may be utilized as a distribution track with a magnetic power connector connected both magnetically and for power to the distribution track. In one exemplary embodiment, a lighting assembly or lighting bar with one or more magnetic connector lighting systems, such as LEDs or other types of lights. The exemplary low power voltage system may include a configuration or assembly of ferrous material, conductive material, and nonconductive materials arranged in such a way as to provide a method for power and/or signal distribution to a mating device. The mating device may include a set of magnetic LED modules. The mating device may include magnetic materials, such as magnets or magnetic coils, conductive materials, nonconductive materials, and electronics. The conductive materials may be for example spring contacts. The electronics may utilize the distributed power and/or signals.

Figure 1:
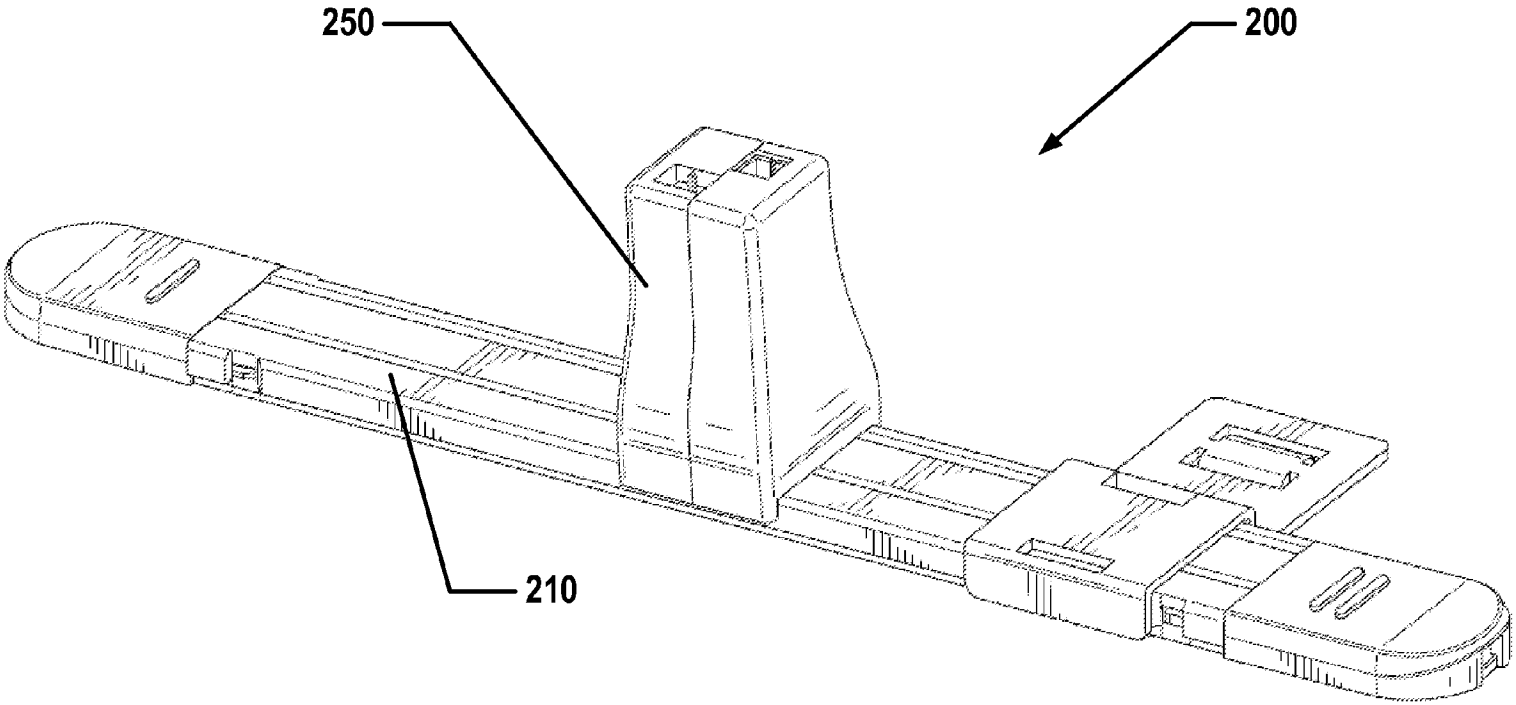
FIG. 1 shows a perspective view of an exemplary lighting assembly that includes a track and connector assembly.
Figure 2:
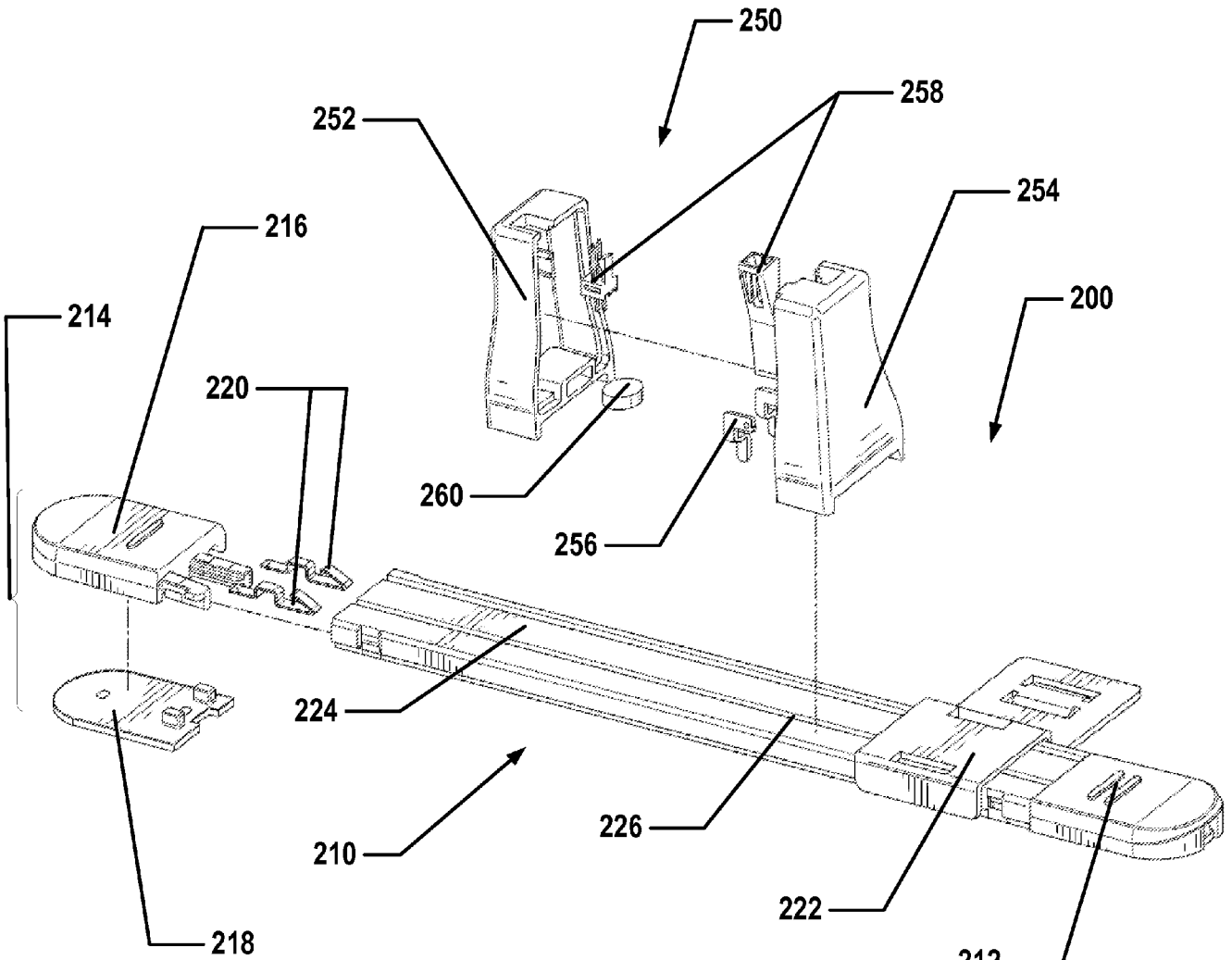
FIG. 2 shows an exploded perspective view of the track and connector assembly from FIG. 1.
Figure 3:
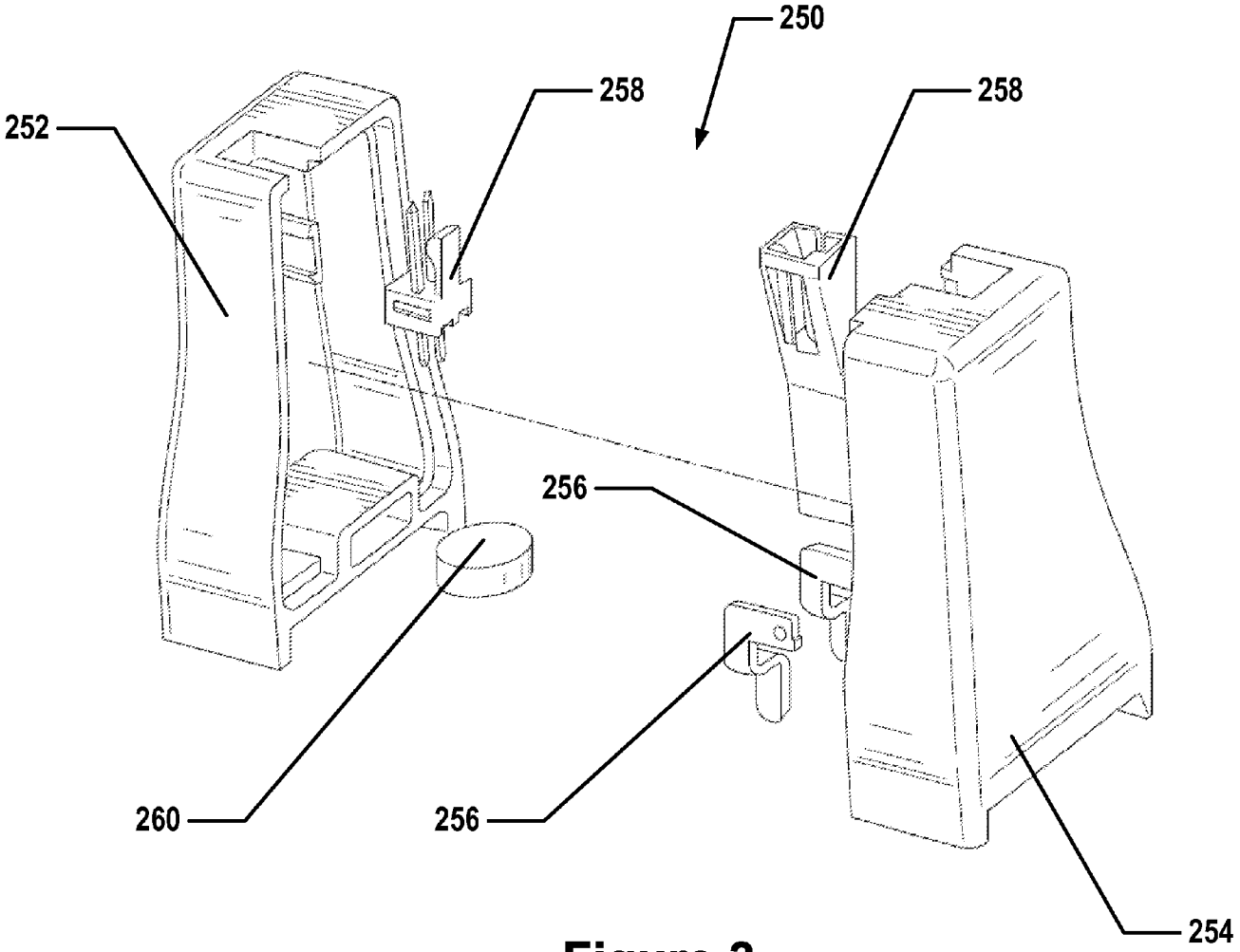
FIG. 3 shows an exploded perspective view of a power connector assembly from the track and connector assembly illustrated in FIG. 1.

As illustrated in one embodiment in FIGS. 1 through 3, an exemplary low power voltage system 200 is shown. In this example, the low voltage power system 200 is an exemplary lighting system. Those of skill in the art will recognize that any low voltage power system may be utilized without departing from these embodiments. The exemplary lighting system 200 may also be a track and connector assembly 200 for use with a retail merchandise display system. The track and connector assembly 200 may include a track 210 and a power connector assembly 250. FIG. 1 illustrates a perspective view of the track and connector assembly 200. FIG. 2 illustrates an exploded perspective view of the track and connector assembly 200 to include both the track 210 and the power connector assembly 250. FIG. 3 illustrates an exploded perspective view of the power connector assembly 250. Generally, the power connector assembly 250 connects to the track 210 both through a magnetic connection and a power connection. The power connector assembly 250 may connect to the track 210 on any part of the track 210.

The track 210 may include a first end assembly 212 and a second end assembly 214. The first end assembly 212 may be non-powered. The second end assembly 214 may include a powered top portion 216, a powered bottom portion 218, and one or more track power contacts 220. Generally, the powered portion (both top 216 and bottom 218) may provide a power source to the track 210 through the one or more track power contacts 220. The track 210 may include one or more bus bars 224 for the power connection and a metal plate 226 for the magnetic connection. The bus bars 224 may be conductive plates or other surfaces and materials that allow the distribution of power. The metal plate 226 may be any ferrous plate or other surfaces and materials for magnetic connections. Those of skill in the art will recognize that any material, shape, form, or type of conductive material may be utilized for the bus bars 224. Additionally, those of skill in the art will recognize that any material, shape, form, or type of ferrous material may be utilized for the metal plates 226, such as brass. The track 210 may also include a track mounting bracket 222. The track mounting bracket 222 may be utilized to mount to the merchandise display system, thereby allowing the track and connector assembly 200 to attach to the merchandise display system at any preferred location. Those of skill in the art will recognize that the merchandise display system may include multiple tracks 210 and multiple power connector assemblies 250 without departing from this invention.

The power connector 250 may include a housing which may include a first or left housing 252 and a second or right housing 254. Within the left housing 252 and the right housing 254 may include one or more power connector contacts 256. The power connector contacts 256 may be configured and located in line with the powered bus bars 224 on the track 210. One or more power connector jacks 258 may be electronically connected to the power connector contacts 256. The power connector jacks 258 may then provide power to a low voltage power device. The low voltage power device may include various lighting systems, such as individual LEDs or other such similar low voltage power assemblies for the merchandise display system.

Additionally, the power connector 250 may include a magnetic source 260 or mating device. The magnetic source may be a magnetic coil, magnet, or induction coil. Other magnetic or mating devices may be utilized without departing from this invention. The magnetic source 260 may be configured and located in line with the metal plate 226 on the track 210. The magnetic source 260 allows the power connector 250 and any low voltage power supply assemblies connected to the power connector 250 the ability to be moved along the entire length of the track 210. For example, individual LEDs may utilized and moved along the entire length of the track 210.

As illustrated in another embodiment in FIGS. 4 through 7, another exemplary low voltage power supply system 300 is shown. In this embodiment, a lighting system 300 is utilized as the low voltage power supply system, however other low voltage power supply systems may be utilized without departing from these embodiments. For example, the exemplary lighting system 300 may also be a track and connector assembly 300 for use with a retail merchandise display system.

Figure 4:
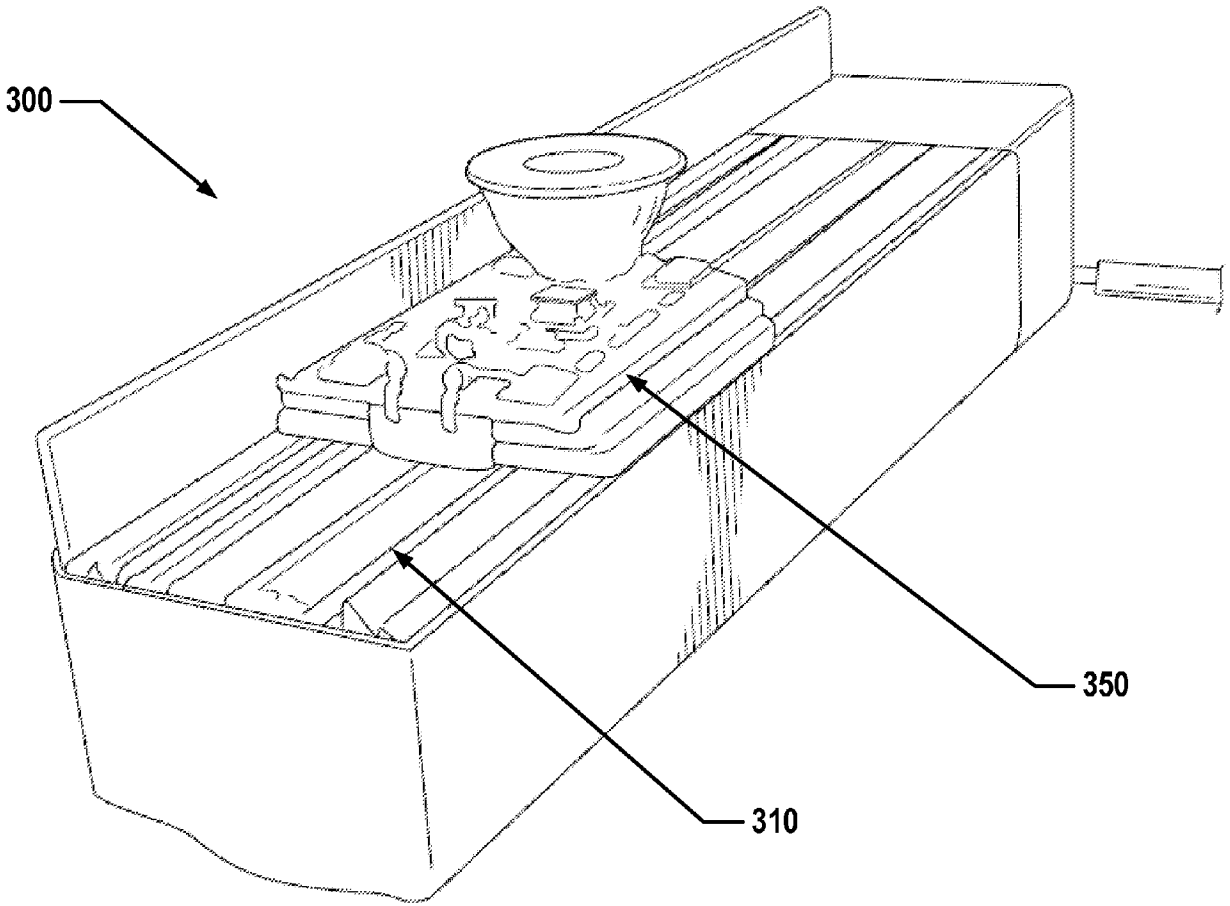
FIG. 4 shows a perspective view of another exemplary lighting assembly that includes a track and connector assembly.
Figure 5:
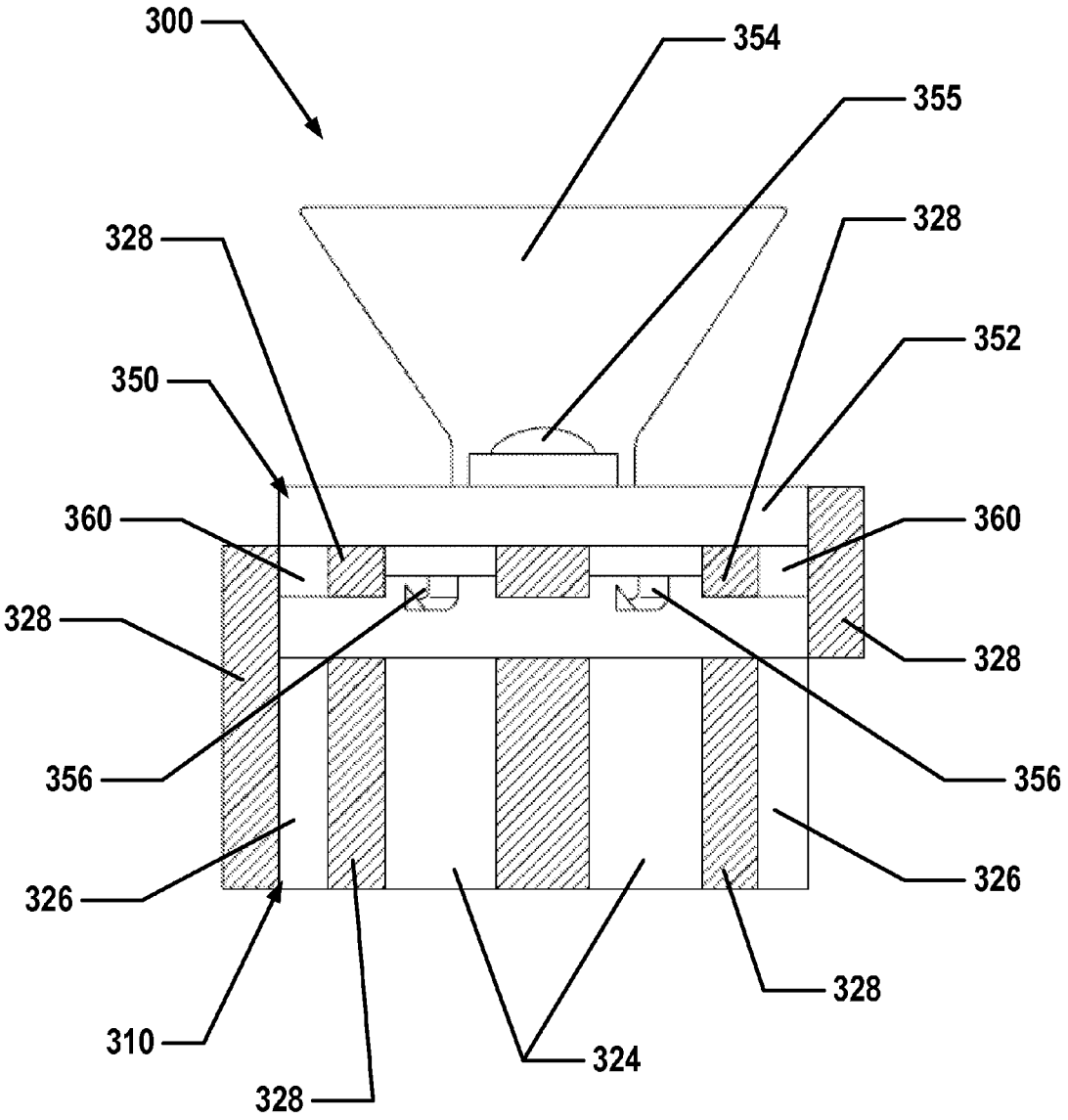
FIG. 5 shows a cross-section view of the track and connector assembly from FIG. 4.
Figure 6:
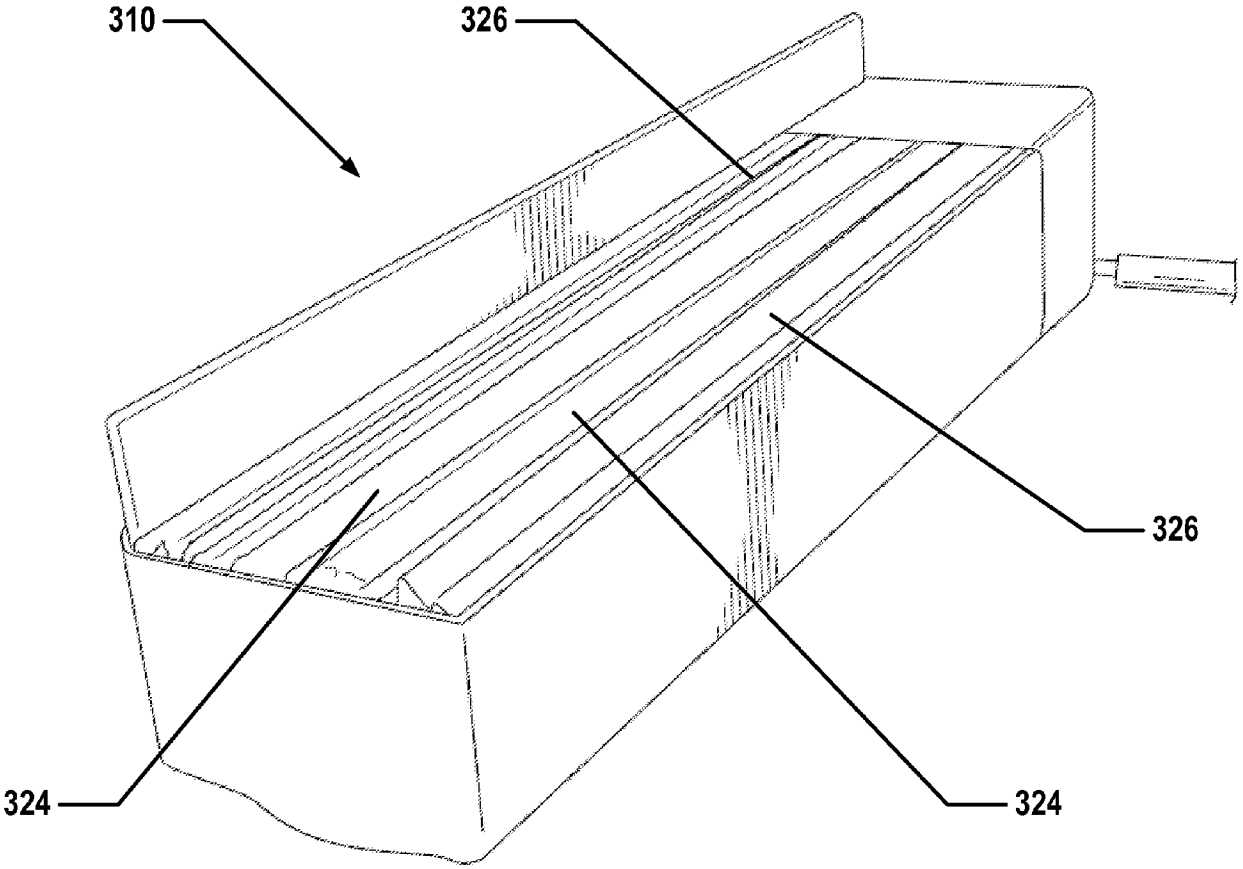
FIG. 6 shows a perspective view of a track from the track and connector assembly illustrated in FIG. 4.
Figure 7:
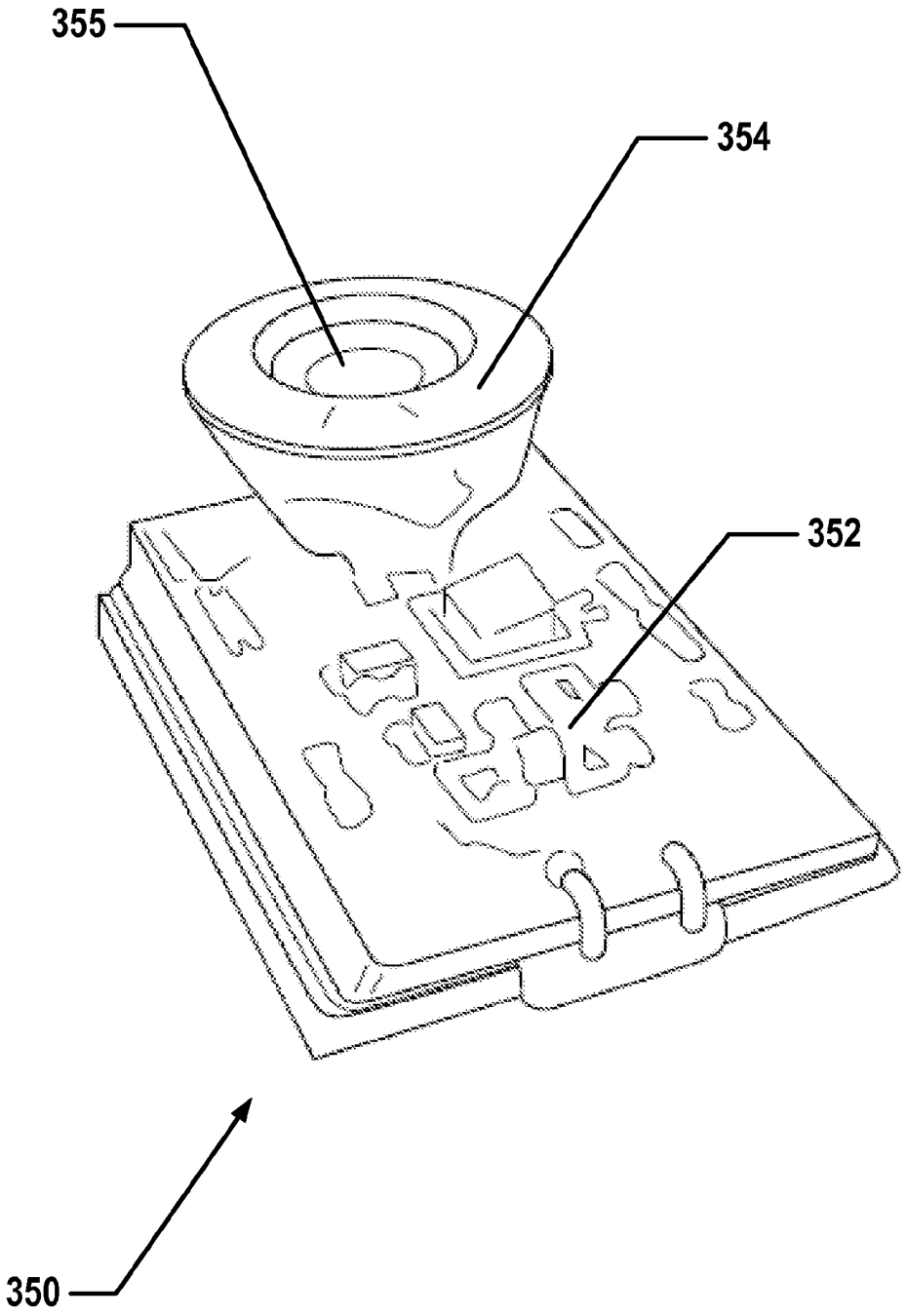
FIG. 7 illustrates a perspective view of a power connector assembly from the track and connector assembly illustrated in FIG. 4.

The track and connector assembly 300 may include a track 310 and a power connector 350. FIG. 4 illustrates a perspective view of the track and connector assembly 300. FIG. 5 illustrates a cross-section view of the track and connector assembly 300 to include both the track 310 and the power connector assembly 350. FIG. 6 illustrates a perspective view of the track 310. FIG. 7 illustrates a perspective view of the power connector assembly 350. Generally, the power connector assembly 350 connects to the track 310 both through a magnetic connection and a power connection. The power connector assembly 350 may connect to the track 310 along any portion of the track 310.

The track 310 may include one or more conductive plates 324 and one or more ferrous plates 326. As illustrated in FIG. 12, a plurality of insulative materials 328 may be located between each of the ferrous plates 326 and the conductive plates 324. Those of skill in the art will recognize that any material, shape, form, or type of ferrous material may be utilized for the ferrous plates 324. Additionally, those of skill in the art will recognize that any material, shape, form, or type of conductive material may be utilized for the conductive plates 326, such as brass. The track 310 may also include a track mounting bracket (not shown in this embodiment). The track mounting bracket may mount to the merchandise display system, thereby allowing the track and connector assembly 300 to attach to the merchandise display system at any preferred location. In another aspect, the track may be a freestanding track without the need for a track mounting bracket. Those of skill in the art will recognize that a merchandise display system may include multiple tracks 310 and multiple power connector assemblies 350 and low voltage power supply systems without departing from this invention.

As illustrated in FIGS. 4, 5, and 6, the power connector 350 may include a printed circuit board 352 which houses the electronics for the power connector 350. In this given embodiment, a lighting assembly 354 that includes one or more LEDs 355 and/or other light sources known and used in the art may be electronically connected to the printed circuit board 352. Other low voltage power supply devices may be utilized and electronically connected to the printed circuit board 352 without departing from this invention. Additionally, the power connector 350 may include one or more power connector contacts 356. The power connector contacts 356 may be configured and located in line with the conductive plates 324 on the track 310. The power connector contacts 356 may be defined by spring contacts or any other type of power contacts known and used in the art. The power contacts 356 may then provide power to the lighting assembly 354, such as individual LEDs or other such similar lighting assemblies for the merchandise display system.

Additionally, the power connector 350 may include a magnetic source 260 or mating device. The magnetic source may be a magnetic coil, magnet, or induction coil. Other magnetic or mating devices may be utilized without departing from this invention. The magnetic source 360 may be configured and located in line with the ferrous plates 326 on the track 310. The magnetic source 360 allows the power connector 350 and any lighting assemblies 354 (or low voltage power connectors) to be connected to the power connector 350 with the ability to be moved along the entire length of the track 310.

These embodiments illustrated in FIGS. 1 through 7 solve the problem with providing power to many devices while trying to create good wire management, and also creating a dynamic or flexible system that allows for device re-location, addition of devices, and removal of devices for the power/signal system. Existing solutions include cable raceways with multiple connection points (outlet strip approach) or powered track systems (track lighting approach). However these traditional approaches fall short in several ways. Although many conductors for power and signal combinations can be used, the "outlet strip approach" lacks flexibility and expandability for adding or relocating devices. Traditional powered track systems lack easy ways to incorporate many power and signal conductors. Additionally for each conductor added to the traditional power track systems the connector required to access those conductors grows significantly in complexity and size.

The purpose of these embodiments illustrated in FIGS. 1 through 7 is to provide a "break away" connection. Another purpose of these embodiments illustrated in FIGS. 1 through 7 is to provide an easy to use power and signal distribution track system. Track lighting is a good example of a powered track system intended for distributing power to many devices, however current track lighting systems do not use magnetic attachment methods and are not intended for distributing more than power for connected devices. These embodiments are intended to distribute both power while allowing the easy movement and placement of connected devices such as lighting systems for the retail merchandise display systems.

Examples of retail uses for this embodiment are under-shelf or display-case lighting that may require spot lights for product specials. Spot light modules such as the proof of concept prototype could be used to add lighting in a dynamic, modular, and reconfigurable way. Examples of non-retail applications might include systems which use sensor modules that communicate via additional conductors in the configuration or assembly. This type of application would allow for easy customization of the sensor system.

If additional voltages are added to the configuration of products, additional configurations of products that require different voltages could be connected on the same distribution track such that the devices contacts make contact only with the conductors required. In a given aspect of this invention, there may two bus bars and/or conductive plates. In another aspect of this invention, there may be four bus bars and/or conductive plates in order to handle various additional voltages.

Other devices using this distribution track may separate the magnetic connector from the device itself by using a corded magnetic connector. This allows for many types of devices (especially larger devices) to make use of the distribution track. One example might be embedded hardware devices which use the distribution track as a means for getting power and for intercommunications between embedded devices utilizing additional signal conductors.

Another advantage of this embodiment is that the distribution track implementations may incorporate many conductors for power and/or signal and may only grow in size as conductors are added. The additional conductors for power and/or signal may not increase the complexity because the access of one conductor does not interfere with the other conductors as it does in the traditional powered track approach. This characteristic allows the design technique to be scalable for many applications.

LED lighting systems may be utilized with these embodiments as a low voltage power supply with magnetic connections, and specifically LED lighting systems utilized with a retail merchandise display system. LED lighting systems as disclosed in U.S. application Ser. No. 13/162,076, filed Jun. 16, 2011 and U.S. application Ser. No. 12/955,198, filed Nov. 29, 2010 wherein each of the above-identified U.S. applications are herein incorporated by reference in their entirety.

In another aspect of this invention, a low voltage power assembly may utilize a mechanical connection instead of the magnetic connection as described above. The mechanical connection may be a snap connector or other kinds of mechanical connections known and used in the art. As was described above, the low voltage power assembly may comprise a track that includes one or more conductive plates and a mechanical connector, wherein the track is powered from a low voltage power source; and a power connector assembly that connects to the track, wherein the one or more conductive plates connect to the power assembly providing a low voltage power connection, and further wherein the mechanical connector connects to the power assembly providing a secure connection. This power connector assembly may be configured to provide low voltage power through the track to a low voltage power device.

The reader should understand that these specific examples are set forth merely to illustrate examples of the invention, and they should not be construed as limiting the invention. Many variations in the lighting assemblies may be made from the specific structures described above without departing from this invention.

While the invention has been described in detail in terms of specific examples including presently preferred modes of carrying out the invention, those skilled in the art will appreciate that there are numerous variations and permutations of the above described systems and methods. Thus, the spirit and scope of the invention should be construed broadly as set forth in the appended claims.

We claim:

1. A low voltage power assembly comprising:

a track that includes a first end and a second end opposite the first end, wherein the track is powered from a low voltage power source;

a power connector assembly that connects to the track both through a magnetic connection and a low voltage power connection, wherein the power connector assembly includes one or more power connector contacts that are electrically connected to one or more power jacks, and further wherein the magnetic connection allows the power connector assembly the ability to be moved along the entire length of the track while maintaining the low voltage power connection, wherein the power connector assembly provides low voltage power through the track to a low voltage power device.

2. The low voltage power assembly of claim 1, wherein the first end is a powered end and the second end is a non-powered end.

3. The low voltage power assembly of claim 1, wherein the track includes one or more conductive plates that connect to the power connector assembly providing the low voltage power connection.

4. The low voltage power assembly of claim 3, wherein the one or more conductive plates are bus bars.

5. The low voltage power assembly of claim 3, wherein the one or more conductive plates are made of brass.

6. The low voltage power assembly of claim 1, wherein the track includes one or more metal plates that connect to the power connector assembly providing the magnetic connection.

7. The low voltage power assembly of claim 6, wherein the one or more metal plates are made of ferrous metals.

8. The low voltage power assembly of claim 1, wherein the low voltage power device is a merchandise display LED lighting system.

9. A low voltage power assembly comprising:

a track that includes one or more ferrous plates and one or more conductive plates adjacent to one another, wherein the track is powered from a low voltage power source;

a printed circuit board that connects to the track both through a magnetic connection and a low voltage power connection, wherein the printed circuit board includes one or more power connector contacts that are electrically connected to one or more power jacks, and further wherein the magnetic connection allows the printed circuit board the ability to be moved along the entire length of the track while maintaining the low voltage power connection, wherein the printed circuit board provides low voltage power through the track to a low voltage power device.

10. The low voltage power assembly of claim 9, wherein the track further includes insulating plates positioned between the one or more ferrous plates and the one or more conductive plates.

11. The low voltage power assembly of claim 9, wherein the printed circuit board includes one or more contacts that connect to the one or more conductive plates on the track providing the low voltage power connection.

12. The low voltage power assembly of claim 9, wherein the one or more conductive plates are made of brass.

13. The low voltage power assembly of claim 9, wherein the printed circuit board includes one or more magnets that connect to the one or more ferrous plates on the track providing the magnetic connection.

14. The low voltage power assembly of claim 9, wherein the low voltage power device is a merchandise display LED lighting system.

15. A low voltage power assembly comprising:

a track that includes one or more conductive plates and one or more metal plates, wherein the track is powered from a low voltage power source;

a power connector assembly that connects to the track, wherein the one or more conductive plates connect to the power assembly providing a low voltage power connection, and further wherein the one or more metal plates connect to the power assembly providing a magnetic connection, wherein the power connector assembly includes one or more power connector contacts that are electrically connected to one or more power jacks, and further wherein the magnetic connection allows the power connector assembly the ability to be moved along the entire length of the track while maintaining the low voltage power connection, wherein the power connector assembly provides low voltage power through the track to a low voltage power device.

16. The low voltage power assembly of claim 15, wherein the one or more conductive plates are bus bars.

17. The low voltage power assembly of claim 15, wherein the one or more conductive plates are made of brass.

18. The low voltage power assembly of claim 15, wherein the one or more metal plates are made of ferrous metals.

19. The low voltage power assembly of claim 15, wherein the track further includes insulating plates positioned between the one or more metal plates and the one or more conductive plates.

20. The low voltage power assembly of claim 15, wherein the low voltage power device is a merchandise display LED lighting system.

* * * * *